US010214384B2

(12) United States Patent
Sonnenmoser et al.

(10) Patent No.: US 10,214,384 B2
(45) Date of Patent: Feb. 26, 2019

(54) METHOD FOR OPERATING AN ELEVATOR SAFETY SYSTEM WITH TEMPORARY PARTICIPANTS

(71) Applicant: Inventio AG, Hergiswil (CH)

(72) Inventors: Astrid Sonnenmoser, Hochdorf (CH); Ivo Lustenberger, Buttisholz (CH); Martin Hess, Baar (CH)

(73) Assignee: INVENTIO AG, Hergiswil NW (CH)

( * ) Notice: Subject to any disclaimer, the term of this patent is extended or adjusted under 35 U.S.C. 154(b) by 42 days.

(21) Appl. No.: 15/535,759

(22) PCT Filed: Dec. 15, 2015

(86) PCT No.: PCT/EP2015/079748
§ 371 (c)(1),
(2) Date: Jun. 14, 2017

(87) PCT Pub. No.: WO2016/096826
PCT Pub. Date: Jun. 23, 2016

(65) Prior Publication Data

US 2017/0341905 A1 Nov. 30, 2017

(30) Foreign Application Priority Data

Dec. 18, 2014 (EP) ..... 14199056

(51) Int. Cl.
*B66B 1/34* (2006.01)
*B66B 5/00* (2006.01)
*B66B 13/22* (2006.01)

(52) U.S. Cl.
CPC ..... *B66B 5/0031* (2013.01); *B66B 1/3407* (2013.01); *B66B 5/0025* (2013.01); *B66B 13/22* (2013.01)

(58) Field of Classification Search
CPC ... B66B 5/0031; B66B 1/3407; B66B 5/0025; B66B 13/22
(Continued)

(56) References Cited

U.S. PATENT DOCUMENTS 4,650,037 A * 3/1987 Husson ..... B66B 5/02 187/380
4,958,707 A * 9/1990 Yoneda ..... B66B 1/3415 187/247

(Continued)

FOREIGN PATENT DOCUMENTS

CN 103068710 A 4/2013
EP 1159218 A1 12/2001

(Continued)

*Primary Examiner* — Anthony Salata
(74) *Attorney, Agent, or Firm* — William J. Clemens; Shumaker, Loop & Kendrick, LLP

(57) ABSTRACT

A method for operating a safety system including a control unit, a bus, a plurality of bus nodes connected to the control unit via the bus, and a plurality of participants connected to the control unit via the bus nodes, wherein at least one participant is designed as a temporary participant. The method includes the step of enabling the safety system for operation by the control unit when either a first temporary participant or a second temporary participant is connected to the bus. An elevator system can be provided with a safety system for carrying out the method.

14 Claims, 3 Drawing Sheets

(58) Field of Classification Search
USPC ..... 187/247, 248, 313, 316, 380–388, 391, 187/393
See application file for complete search history.

(56) References Cited

U.S. PATENT DOCUMENTS

| | | | | | |
|---|---|---|---|---|---|
| 5,010,472 | A * | 4/1991 | Yoneda | B66B 1/18 | 187/391 |
| 5,387,769 | A * | 2/1995 | Kupersmith | G06F 11/1625 | 187/248 |
| 6,173,814 | B1 * | 1/2001 | Herkel | B66B 1/34 | 187/248 |
| 7,172,055 | B2 * | 2/2007 | Engel | B66B 5/0087 | 187/391 |
| 7,344,004 | B2 * | 3/2008 | Engel | B66B 1/34 | 187/247 |
| 8,807,284 | B2 * | 8/2014 | Sonnenmoser | B66B 13/22 | 187/248 |
| 8,967,335 | B2 * | 3/2015 | Friedli | B66B 1/2458 | 187/247 |
| 2017/0349404 | A1 * | 12/2017 | Sonnenmoser | B66B 1/28 | |
| 2017/0355559 | A1 * | 12/2017 | Sonnenmoser | B66B 5/0031 | |

FOREIGN PATENT DOCUMENTS

| | | | |
|---|---|---|---|
| WO | 0051929 | A1 | 9/2000 |
| WO | 2010097404 | A1 | 9/2010 |
| WO | 2013020806 | A1 | 2/2013 |
| WO | 2014048826 | A1 | 4/2014 |

* cited by examiner

5a TARGET LIST

| ADD | ID1 | ID2 | Description | W | N |
|---|---|---|---|---|---|
| 41 | SS | AAA | Shaft door (61) floor 1 | A | A |
| 42 | SS | BBB | Shaft door (62) floor 2 | A | A |
| 43 | SS | CCC | Shaft door (63) floor 3 | A | A |
| 44 | TT | DDD | Elevator door (74) | A | A |
| 45 | UU | EEE | Safety brake(75) | A | A |
| 46 | VV | FFF | Emergency switch(76) | A | A |
| 47 | WW | GGG | Brake (87) | A | A |
| 48 | XX | HHH | speed (88) | A | A |
| 49 | YY | III | Temporary participant (89a) | A | I |
| 50 | ZZ | JJJ | Temporary participant (89b) | I | A |

Fig. 2

METHOD FOR OPERATING AN ELEVATOR SAFETY SYSTEM WITH TEMPORARY PARTICIPANTS

FIELD

The invention relates to a method for operating a safety system with temporary participants as well as a safety system that is provided to carry out this method and an elevator system having this safety system.

BACKGROUND

Elevator systems are provided with safety systems for safe operation. These safety systems typically are made up of safety elements connected in series. These safety elements can, for example, monitor the condition of shaft or car doors. Electromechanical safety circuits or even bus-based safety circuits are known. The safe operation of such bus-based safety circuits is inspected regularly. The design and testing of such bus-based safety circuits are known from EP 1159218 A1, WO 2010/097404 A1 or WO 2013/020806 A1, for example. From this prior art, however, it is not obvious whether, or to what extent, safety is ensured when connecting or disconnecting temporary participants, such as a manual control device for controlling the elevator system during maintenance or an input device, via which configuration settings can be set for the safety system.

SUMMARY

It is therefore the object of the invention to specify a method or a safety system and an elevator system having such a safety system by which a safe operation using temporary participants is ensured.

A safety system of the elevator system includes a control unit, a bus, a plurality of bus nodes that are connected to the control unit via the bus, and a plurality of participants that are connected to the control unit via bus nodes.

Control unit here refers to a unit that has at least one microprocessor, one RAM and one ROM. Such a control unit is thus designed to execute computer-based programs. The control unit is configured as a safety control unit that monitors safety conditions of the elevator system and brings the elevator system to a halt in the event of an unsafe condition. This includes, for example, monitoring the shaft door states, wherein the elevator is shut down.

Sensors, switching contacts, operating elements or actuators that, on one hand, monitor a condition of the elevator system and, on the other, exert influence on the safe operation of the elevator system, are considered to be participants here. This includes position, speed or acceleration sensors that monitor the state of motion of an elevator car, as well as switching contacts that monitor the shaft or car door condition or the failure of the elevator car to stop at a specified end position. A safety system can also include operating elements, by which commands for the control of the safety system or the elevator system, the configuration of the safety system or the selection of an operating mode can be entered, such as a control button, an input screen or a manual control device. Actuators refer to all components that can be controlled by the control unit in order to return an elevator to a safe condition after the detection of an unacceptable condition, such as a drive motor, a holding brake or a safety brake. This list of the aforementioned participants is only an example and not exhaustive.

The safety system can have at least one participant that is designed as a temporary participant. A temporary participant here refers to a participant that is only connected on a temporary basis via a bus node to the safety system or the control unit. Such temporary participants can, for example, be designed as operating elements, governor elements or bridging elements that are, or should be, connected to the safety system only in a specified operating mode, such as a normal operating mode, a maintenance operating mode or a configuration mode.

The safety system is preferably enabled by the control unit if either the first temporary participant or the second temporary participant is connected to a bus. One of two specified temporary participants must therefore be connected to the bus in order for operation of the safety system and, accordingly, also the elevator system, to be possible. This requires a structured management of the elevator system and promotes safe working practices on the elevator system, above all for work activities that take place inside the shaft.

Preferably, the safety system is set in a fault mode if neither the first temporary participant nor the second temporary participant, or both the first temporary participant and the second temporary participant are connected to the bus.

Fault mode refers to a mode, in which the elevator system cannot be operated, at all, or only to a limited extent. In general, the elevator system is shut down in fault mode so that a potentially hazardous situation absolutely cannot occur. If necessary, one last trip of the elevator car to the closest floor could still be permitted to prevent passengers from being stranded in the elevator car. The elevator system can then be returned to operation if the situation that has led to the fault mode is reversed. So, for example, if a temporary participant is removed after both temporary participants had previously been connected to the system, so that only one of the two temporary participants is reconnected to the bus.

Preferably, a first operating mode, in particular a maintenance mode, is only enabled by the control unit if the first temporary participant, in particular a manual control device or an input interface, is connected to the bus. Correspondingly, a second operating mode, in particular a normal operation mode, is only enabled by the control unit if the second temporary participant, in particular a governor unit, is connected to the bus.

Manual control device here refers to a device for controlling the elevator system that is operated during maintenance work by a maintenance technician. This manual control device preferably includes four control elements, namely a button each for implementation of an upwardly or downwardly directed trip, a button for releasing an emergency stop and, optionally, a switch for activating or deactivating the maintenance mode.

A governor element here refers to an element that is connected to the safety system in place of the first temporary participant. No function is specific to the governor element except that it enables a specific operating mode. The governor element can, for example, be designed as a simple bridging element.

This ensures that all participants necessary for a specific operating mode, in particular also temporary participants, are connected to the safety system. This is true, for example, for a manual control device in maintenance mode. It can be provided in maintenance mode that control instructions can only be entered using the manual control device. The safety of the maintenance technician is thus guaranteed, who can rely on the fact that only commands entered by him on the manual control device will be implemented by the elevator system as a movement of the elevator car.

In addition, the manual control device connected to the safety system unambiguously indicates to the maintenance technician that the elevator system is in maintenance mode and ready for maintenance operations, meaning that all safety precautions necessary in maintenance mode are monitored by the control unit, or, at least, that a normal operation has not been enabled because the governor element is not connected to the safety unit.

It is especially beneficial, if the first temporary participant and the second temporary participant can each be connected to the safety system using an assigned bus node. In a particularly advantageous embodiment, both bus nodes are arranged in spatial proximity to each other. A maintenance technician can thus detect with one glance in which operating mode the elevator finds itself. These bus nodes are preferably arranged in one place in the elevator system that is first of all located in the work area for maintenance operations and secondly is easily available to a maintenance technician. These bus nodes can also be arranged, for example, in a car roof or in a shaft cavity.

The first or the second temporary participant is preferably physically connected to the safety system, for example via the assigned bus node at a slot provided on the bus for that purpose, or the temporary participant is connected wirelessly to the safety system, for example via a WLAN, Bluetooth or other type of radio connection.

Preferably, the first or second temporary participant is logged into the safety system by the first or the second temporary participant A) being connected to the safety system at a bus node, B) the first or the second temporary participant is recognized by the control unit, and C) the first or the second temporary participant is incorporated into the safety system by the control unit.

To do this, a target list of participants is implemented on the control unit that contains at least data for an identification number for each participant. The first or the second temporary participant is recognized by the control unit if the control unit determines a match by comparing an identification number of the first or the second temporary participant to the identification numbers in the target list.

The identification number represents a number, by which a participant connected to the safety system is recognized; in particular, this number can represent an identification number unique to each participant or an identification number declaring the type of participant. The identification number can be stored on a memory medium of the participant. The target list defines an expectation of the control unit as to which participant should be connected to the safety system. Accordingly, there is an entry in the target list for each participant that can be connected to the safety system. This entry includes at least one identification number. Therefore, if the first or the second temporary participant is connected to the safety system, the control unit checks whether this participant or its identification number is included in the target list. If the test is positive or the identification number is included in the target list, the temporary participant is considered recognized.

Preferably, the recognized first or second temporary participant is connected by the control unit by an entry of the recognized first or second temporary participant being set from an inactive to an active status in the target list. This can be accompanied by a change of the operating mode. An activation status can thus be stored on the target list for a temporary participant, which takes the participant into a specific mode of operation. In this context, upon recognizing the temporary participant, the control unit can automatically switch into the operating mode that is stored as an active status in the target list entry for the temporary participant. A first operating mode, for example a maintenance mode, could have a higher priority than a second operating mode, for example a normal operating mode.

Preferably, the first or the second temporary participant is logged off the safety system by D) a disconnection of the first or the second temporary participant from the safety system via a manipulation of the safety system being signaled and E) the temporary participant is disconnected from the safety system.

By means of the manipulation to the safety system, an expectation can be created in the control unit that can be used to monitor the log-off procedure of a corresponding temporary participant. This manipulation can, for example, be accomplished via a switching element of a manual control device or via a touch-sensitive screen of an input device.

Preferably, the first or the second temporary participant is logged off of the control unit by the entry for the temporary participant in the target list being set from active to inactive status by the control device. Analogous to the log-on process, this can be accompanied by a change in the operating mode.

An actual list of participants is preferably implemented on the control unit that represents an image of the participants connected to the safety system and an operation of the elevator system is only enabled if, after a comparison of the active participants entered in the target list by the control unit to the participants entered into the actual list, a match is found.

The actual list represents a list having all of the participants connected to the safety system at a given instant. Preferably, all recognized participants are listed in the actual list based on their identification numbers. The comparison between the participants entered in the actual list to the participants stored in the target list, in particular those that have an active status for a specific operating mode, is preferably carried out based on the identification numbers included in both lists. This comparison ensures that all participants provided for a specific operating mode are connected to the safety system before a corresponding operating mode is enabled.

A further aspect of the invention relates to a safety system for an elevator system for carrying out the method, as well as an elevator system having the aforementioned safety system.

DESCRIPTION OF THE DRAWINGS

The invention is further described in the following using exemplary embodiments. Shown are:

FIG. 2 is an exemplary embodiment of a target list that is implemented on the control device of the safety system;

DETAILED DESCRIPTION

Figure 1:
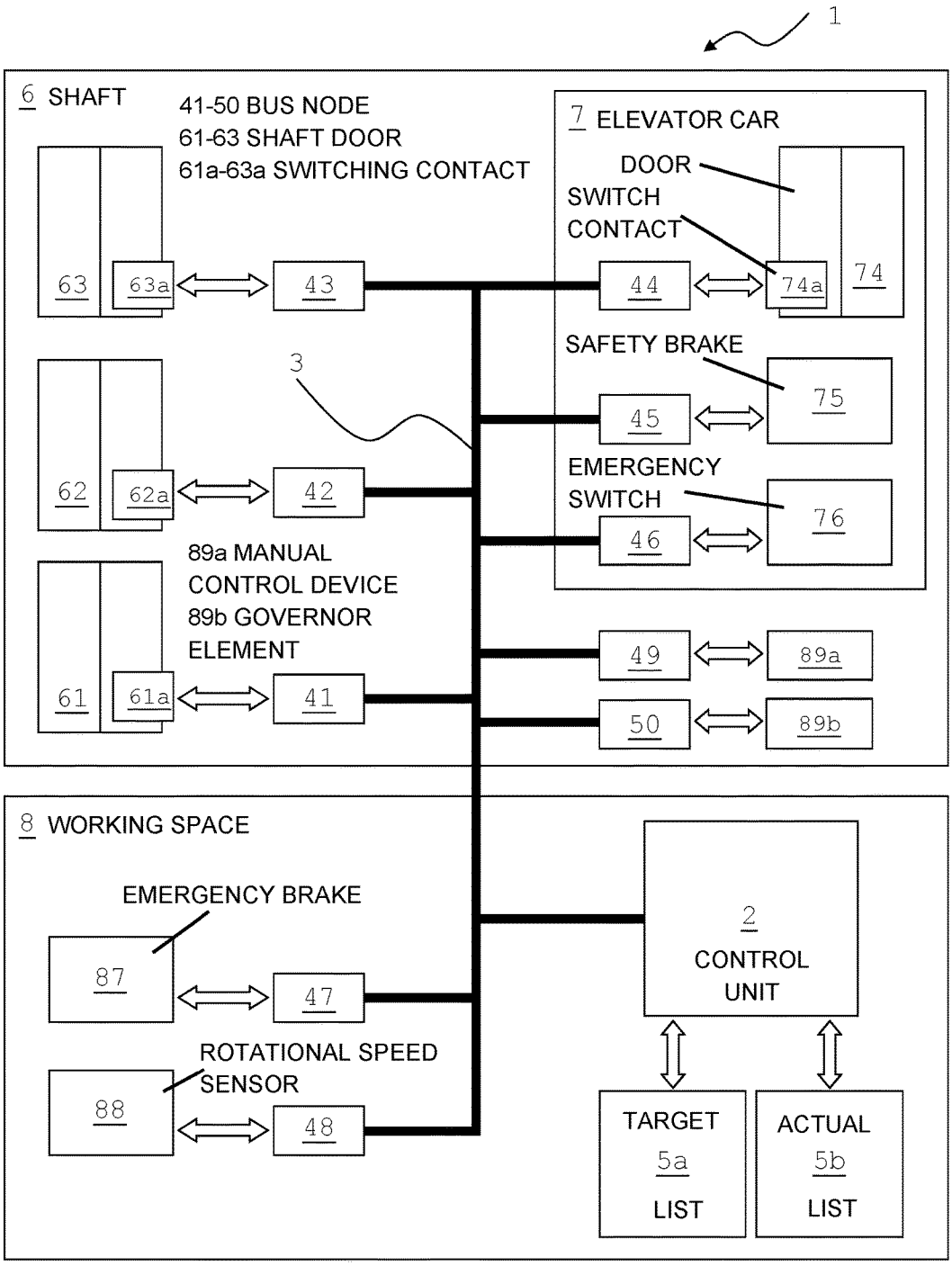
FIG. 1 is a schematic of an exemplary arrangement of an elevator system according to the invention.

The elevator system 1 schematically illustrated in FIG. 1 includes a control unit 2 that is connected via a bus 3 to a plurality of bus nodes 41 to 50. Control unit 2 can be arranged in a separate working space 8, as shown in FIG. 1. In a preferred embodiment, control unit 2 can also be arranged in a shaft 6.

A shaft 6 of a building in which elevator system 1 is installed is schematically represented using reference character 6. The building, for example, has three floors, where each floor is equipped with a shaft door 61, 62 or 63. Shaft door 61 is assigned to bus node 41, shaft door 62 with bus node 42 and shaft door 63 with bus node 43.

Each bus node 41, 42 or 43 is assigned to one participant, here, for example, a switching contact 61*a*, 62*a*, 63*a* that includes information concerning the condition of the assigned shaft door 61, 62 or 63 (open, closed, locked) and, if necessary, can generate an error message for control unit 2.

Elevator system 1 also has an elevator car 7. Elevator car 7 is equipped with an elevator door 74 that also is assigned to a bus node 44. An additional participant, for example an additional switching contact 74*a*, is also assigned to bus node 44, which can determine information concerning the condition of the assigned elevator door 74 (open, closed, locked) and create an error message for control unit 2, if necessary.

Elevator system 1 can also have a bus node 45 and a bus node 46 that are each assigned to additional participants, namely with a safety brake 75 and an emergency switch 76 on elevator car 7. Safety brake 75 serves as a safety brake for elevator car 7, for example, if the latter reaches an excess speed. By activating the emergency switch 76, elevator system 1 can be brought to an immediate stop in an emergency situation.

In a working space 8, an additional drive unit is arranged that is equipped with two additional participants, namely with an emergency brake 87 and with a rotational speed sensor 88, each of which is assigned to a bus node 47 and 48. In a preferred embodiment, the drive unit can be arranged in shaft 6, a separate working space being omitted.

Furthermore, two bus nodes 49, 50 are provided that are arranged in the area of shaft 6 and are each configured to accommodate a first temporary participant and a second temporary participant, namely a manual control device 89*a* or a governor element 89*b*. Bus nodes 49, 50 can, in particular, be arranged on the roof of car 7 or in the cavity of shaft 6, depending upon the position of elevator system 1 at which maintenance operations are to be performed that require a movement of elevator car 7. Both temporary participants 89*a*, 89*b* are thus connected via the assigned bus nodes 49, 50 to bus 3 or control unit 2.

In the example shown, both temporary participants 89*a*, 89*b* can each be connected to the safety system at a slot of bus 3 via the corresponding bus nodes 49, 50. Alternately, both temporary participants 89*a*, 89*b* can also be connected wirelessly to bus 3, for example via a WLAN, a Bluetooth or a radio connection.

Manual control unit 89*a* is designed to control elevator system 1 or elevator car 7 during a maintenance mode and includes, for example, four control elements, namely a button each for implementation of an upwardly or downwardly directed trip, a button for triggering an emergency halt and, optionally, a switch for activating or deactivating a maintenance mode.

Governor element 89*b* is connected to bus 3 instead of manual control unit 89*a*, and is, for example, designed as a simple bridging element.

Control unit 2 has a target list 5*a*, which defines an expectation of control unit 2. Target list 5*a* includes, for example, a list of which of participants 61*a*-63*a*, 74*a*, 75, 76, 87, 88, 89*a*, 89*b* should be connected to bus 3 at a given instant. In addition, control unit 2 has an actual list 5*b* that represents a list of all participants 61*a*-63*a*, 74*a*, 75, 76, 87, 88, 89*a*, 89*b* currently connected to bus 3.

Target list 5*a* is explained in detail in reference to FIG. 2. Target list 5*a* includes an entry for each participant contained therein. This entry corresponds to a line in the table. In a first column is stored a bus address ADD of a bus node 41 to 50, to which a respective participant 61*a*-63*a*, 74*a*, 75, 76, 87, 88, 89*a*, 89*b* is connected. Via bus address ADD, control unit 2 can communicate with a bus node 41 to 50 or to a participant 61*a*-63*a*, 74*a*, 75, 76, 87, 88, 89*a*, 89*b* connected to it. Accordingly, control unit 2 can, for example, address control signals via bus address ADD, 45 to a corresponding participant, for example to safety brake 75 or query specific conditions of the switching contact 61*a* on bus address ADD, 41.

In a second column, a first identification number ID1 of a participant 61*a*-63*a*, 74*a*, 75, 76, 87, 88, 89*a*, 89*b* is stored. This first identification number ID1 depends on the type of participant. Thus participants 61*a* to 63*a* consequently all have the same first identification number ID1 with the value SS, because all three participants are designed as equivalent switching contacts 61*a* to 63*a*, which monitor the state of one of assigned shaft doors 61 to 63. A safety brake 75, however, has a different first identification number ID1 having the value UU.

Participants 61*a*-63*a*, 74*a*, 75, 76, 87, 88, 89*a*, 89*b* can also be identified via a second identification number 102. This second identification number 102 represents for each participant 61*a*-63*a*, 74*a*, 75, 76, 87, 88, 89*a*, 89*b*, for example, a number AAA to JJJ that enables a unique identification of each participant 61*a*-63*a*, 74*a*, 75, 76, 87, 88, 89*a*, 89*b*.

Finally, there is an activation value A or I stored in target list 5*a* for each participant 61*a*-63*a*, 74*a*, 75, 76, 87, 88, 89*a*, 89*b*, wherein activation value A represents an active status and activation value I an inactive status for a participant 61*a*-63*a*, 74*a*, 75, 76, 87, 88, 89*a*, 89*b*. Target list 5*a* shown has activation values A, I for each of two different operating modes of elevator system 1, namely for a normal operating mode N and for a maintenance mode W. Thus, for example, for first temporary participant 89*a* or the manual control unit, an activation value A is specified for a maintenance mode W and an activation value I for a normal operating mode N. Manual control device 89*a* is also assigned an active status in maintenance mode W and, in normal operating mode, an inactive status. Manual control device 89*a* is here assigned a higher priority for maintenance mode W than for normal operating mode N.

Control unit 2 issues a release for an operation of elevator system 1 if either the first temporary participant or manual control device 89*a* or the second temporary participant or governor element 89*b* is connected to bus 3 via the corresponding bus nodes 49, 50. Control unit 2 accordingly interrupts an operation of elevator system 1 if neither of the two temporary participants 89*a*, 89*b* is connected or both temporary participants 89*a*, 89*b* are simultaneously connected to bus 3.

Upon connection of manual control device 89*a* to bus node 49, maintenance mode W is enabled by control device 2. However, if governor element 89*b* is connected to bus node 50, a normal operating mode N is enabled by control unit 2. In maintenance mode W, control instructions can only be given to elevator system 1, for example, via manual control device 89*a*.

Depending upon which operating mode N, W elevator system 1 is in, different activation values are stored in target list 5*a* for participants 61*a* to 63*a*, 74*a*, 75, 76, 88, 87, 89*a*, 89*b*. Accordingly, depending on operating mode N, W in control unit 2, a different expectation is created corresponding to which participant must be connected to bus 3 so that an operational release for the assigned operating mode N, W takes place. Participants 61*a* to 63*a*, 74*a*, 75, 76, 88, 87, which are permanently connected to bus 3 are, of course, activated in both operating modes W, N. Temporary participants 89*a*, 89*b*, however, are each only activated in one of operating modes N, W, namely manual control device 89*a* for maintenance mode W and governor element 89*b* for normal operating mode N.

Figure 3:
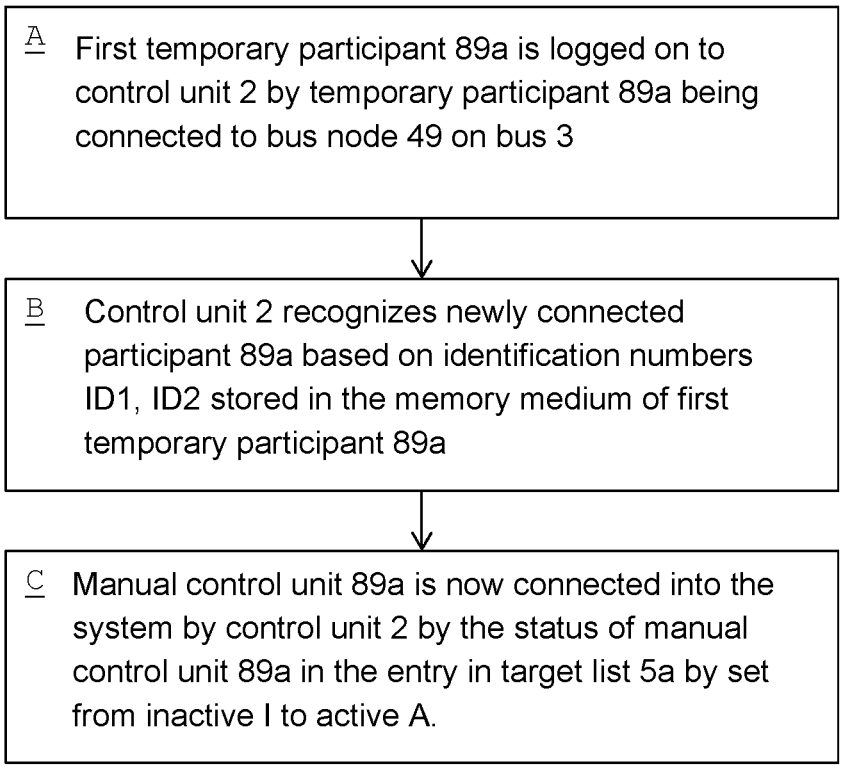
FIG. 3 is a flow chart having an exemplary sequence of a log-on procedure of a temporary participant of the safety system.

First temporary participant 89*a* is logged on to control unit 2 by temporary participant 89*a* being connected to bus node 49 on bus 3 in a first step A according to FIG. 3. Control unit 2 recognizes newly connected participant 89*a* in a second step B based on identification numbers 101, 102 stored in the memory medium of first temporary participant 89*a*. In the example shown, first identification number 101 shows the type for first temporary participant 89*a*, meaning that it is manual control device 89*a*. Second identification number 102 represents a unique identification number of temporary participant 89*a*. A plurality of manual control devices 89*a* can thus be differentiated or assigned to a maintenance technician. Correspondingly, a plurality of second identification numbers 102 can be stored for the entry of manual control device 89*a*, or alternatively, an entry with a separate second identification number 102 can be stored for each different manual control unit 89*a*.

In the example shown, for manual control unit 89*a*, for example, a first identification number 101 having the value YY and a second identification number 102 having the value III is stored. If, then, manual control unit 89*a* having corresponding identification numbers 101 and 102 is connected to bus 3, control unit 2 reads the stored values YY and III from the memory medium of participant 89*a* for identification numbers 101 and 102 and compares them to listed values YY and III in target list 5*a*. If there is a match, participant 89*a* counts as recognized. To do this, first identification number 101 can also be used alone for recognizing participant 89*a*.

In addition, manual control unit 89*a* is now connected into the system by control unit 2 in a third step C by the status of manual control unit 89*a* in the entry in target list 5*a* by set from inactive I to active A. For example, this can be done with an automatic change of operating mode, namely from a normal operating mode N to a maintenance mode W. Based on activation values A, I stored in target list 5*a* for the temporary participant, control unit 2 can automatically switch into maintenance mode W after recognition of manual control device 89*a*. Optionally, control unit 2 can also be so programmed that maintenance mode W is only enabled once the activation switch on manual control unit 89*a* is operated. Upon completion of activation of manual control unit 89*a*, it is considered to be incorporated into the safety system.

After manual control unit 89*a* is recognized and incorporated, manual control unit 89*a* can take over the functions intended for it, namely the control of elevator system 1 during maintenance mode W.

Figure 4:
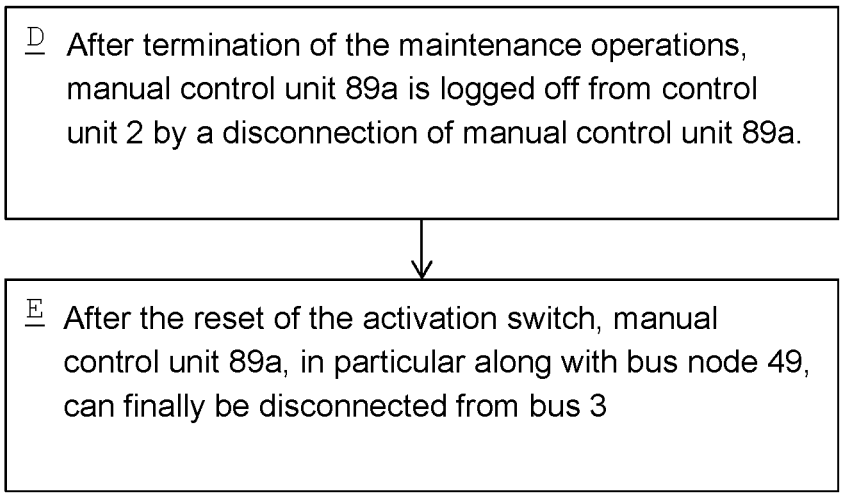
FIG. 4 is a flow chart having an exemplary sequence of a log-off procedure of a temporary participant of the safety system.

After termination of the maintenance operations, manual control unit 89*a* is logged off from control unit 2 by, in a further step D according to FIG. 4, a disconnection of manual control unit 89*a*, in particular along with bus node 49 of bus 3, being signaled to control unit 2 based on a reset of the activation switch of manual control unit 89*a*. After the reset of the activation switch, manual control unit 89*a*, in particular along with bus node 49, can finally be disconnected from bus 3 in a final step E. By resetting the activation switch, an expectation is created in control unit 2 that can be used for monitoring the log-off process of manual control device 89*a*.

When manual control device 89*a* is logged off, its entry in target list 5*a* by control unit 2 is set from an active status A to an inactive status I. The enabling of normal operating mode finally takes place after connection of governor element 89*b* to bus 3 via bus node 50. The recognition and incorporation of governor element 89*b* thus occurs analogous to the log-in process for manual control device 89*a* described above.

In addition, an actual list 5*b* of participants 61*a*-63*a*, 74*a*, 75, 76, 87, 88, 89*a*, 89*b* is implemented on control unit 2 that represents an illustration of participants 61*a*-63*a*, 74*a*, 75, 76, 87, 88, 89*a*, 89*b* connected to the safety system at a given instant. Actual list 5*b* is structured in a similar manner as target list 5*a* and includes essentially the first four columns from target list 5*a*. Control unit 2 thus reads for each existing bus node 41 to 50 its address ADD and the identification numbers 101, 102 of the participants 61*a*-63*a*, 74*a*, 75, 76, 87, 88, 89*a*, 89*b* connected to the respective bus node 41 to 50. Operation of elevator system 1 is only enabled by control unit 2 if control unit 2, upon comparison of identification numbers 101, 102, in particular identification numbers 101, 102 of the entries in target list 5*a*, for which an active status is stored for a particular operating mode N, W, finds a match to those in actual list 5*b*.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for operating a safety system of an elevator system including a control unit, a bus, a plurality of bus nodes connected to the control unit via the bus, and a plurality of participants connected to the control unit via the bus nodes, wherein at least one of the participants is designed as a temporary participant, comprising the steps of:

designating one of the participants as a first temporary participant;

designating another one of the participants as a second temporary participant; and releasing the safety system for operation by the control unit, if either the first temporary participant or the second temporary participant is connected to the bus.

2. The method according to claim 1 including setting the safety system in a fault mode if neither the first temporary participant nor the second temporary participant is connected to the bus, or both the first temporary participant and the second temporary participant are connected to the bus.

3. The method according to claim 1 including enabling by the control unit a maintenance mode only if the first temporary participant is connected to a bus.

4. The method according to claim 3 wherein the first temporary participant is a manual control unit or an input device.

5. The method according to claim 1 enabling by the control unit a normal operation mode only if the second temporary participant is connected to the bus.

6. The method according to claim 5 wherein the second temporary participant is a governor unit.

7. The method according to claim 1 including logging on the first temporary participant or the second temporary participant in the safety system by:

A) the first temporary participant or the second temporary participant being connected to the safety system via the bus;

B) the first temporary participant or the second temporary participant being recognized by the control unit; and C) the first temporary participant or the second temporary participant being connected by the control unit into the safety system.

8. The method according to claim 7 wherein a target list of the participants is implemented on the control unit and contains at least data for an identification number for each of the participants, and the first temporary participant and the second temporary participant are recognized by the control unit if, upon a comparison of an identification number of the first temporary participant or the second temporary participant to the identification numbers of the target list, a match is found by the control unit.

9. The method according to claim 8 wherein the recognized first temporary participant or the recognized second temporary participant is connected by the control unit by an associated entry in the target list being set from an inactive status to an active status.

10. The method according to claim 1 wherein the first temporary participant or the second temporary participant is logged out of the safety system by:

D) a disconnection of the first temporary participant or the second temporary participant being signaled by the safety system using a manipulation to the safety system; and E) the first temporary participant or the second temporary participant being disconnected from the safety system.

11. The method according to claim 10 wherein a target list of the participants is implemented on the control unit that contains at least data for an identification number for each of the participants, and the first temporary participant or the second temporary participant is logged off by the control unit by an associated entry in the target list being set from active to inactive by the control unit.

12. The method according to claim 1 wherein an actual list of the participants is implemented on the control unit that represents the participants that are connected to the safety system, and an operation of the elevator system is only enabled if, after a comparison of the active participants in a target list to the participants entered into the actual list, a match is found by the control unit.

13. A safety system for an elevator system having a control unit, a bus, a plurality of bus nodes connected to the control unit via the bus, and a plurality of participants of which at least one of the participants is designed as a temporary participant and which are connected to the control unit via the bus nodes, wherein the safety system is configured to implement the method according to claim 1.

14. An elevator system having the safety system according to claim 13.

* * * * *